US007837569B2

(12) United States Patent
Ouellet

(10) Patent No.: US 7,837,569 B2
(45) Date of Patent: Nov. 23, 2010

(54) MANUAL SWING DRIVE MECHANISM

(75) Inventor: Charles Ouellet, 71, Place Massey, Saint-Bruno (CA) J3V-1A2

(73) Assignee: Charles Ouellet, Saint-Bruno (CA)

( * ) Notice: Subject to any disclaimer, the term of this patent is extended or adjusted under 35 U.S.C. 154(b) by 385 days.

(21) Appl. No.: 11/983,437

(22) Filed: Nov. 13, 2007

(65) Prior Publication Data

US 2008/0090667 A1 Apr. 17, 2008

Related U.S. Application Data

(60) Provisional application No. 60/873,534, filed on Dec. 8, 2006.

(30) Foreign Application Priority Data

Dec. 20, 2005 (CA) ..... 2527016

(51) Int. Cl.
*A63G 9/16* (2006.01)
*A63G 9/00* (2006.01)

(52) U.S. Cl. ..... 472/118; 472/121; 472/125

(58) Field of Classification Search ..... 472/118–125; 297/273, 274

See application file for complete search history.

(56) References Cited

U.S. PATENT DOCUMENTS 43,420 A * 7/1864 McDougall ..... 472/118
85,238 A * 12/1868 Odenatt ..... 472/123
390,851 A * 10/1888 Polks ..... 472/122
1,228,694 A * 6/1917 Necott ..... 472/120
1,924,683 A * 8/1933 Fletcher ..... 472/122
2,513,021 A * 6/1950 Harrold ..... 472/122
2,601,887 A * 7/1952 Petersen et al. ..... 472/122
3,480,272 A * 11/1969 Ziebart ..... 472/20
3,889,944 A * 6/1975 Sapienza ..... 472/122
4,456,244 A * 6/1984 Andrews ..... 472/124
5,413,298 A * 5/1995 Perreault ..... 248/228.6
5,711,714 A * 1/1998 Daigle ..... 472/12

* cited by examiner

*Primary Examiner*—Kien T Nguyen

(57) ABSTRACT

This invention relates to a manual swing drive mechanism to be mounted on a swing in order to transmit the swinging movement to a person who cannot do it alone, notably a child. Through a hand operated rocking arm, the assisting person transmits a swinging movement to a swaying member which transfers a pendulum swinging movement to the seat lines of the swing through a set of elongated swinging arms fixed perpendicularly to the swaying member. The functionality of the invention could be expanded into a multi-swing drive mechanism thus allowing one or several assisting persons to transmit a swinging movement to a group of two or more assisted persons.

10 Claims, 5 Drawing Sheets

MANUAL SWING DRIVE MECHANISM

FIELD OF THE INVENTION

The technical subject matter relates generally to playground equipment and, more specifically to a manual swing drive mechanism. The latter has been invented to initiate and maintain with human activation the oscillatory pendulum movement of a swing.

This invention relates and intends to apply to swings in all their pluralities and diversities of use through years and centuries. Beyond the traditional one seat suspended swing there is the double chair suspended one and maybe for the future the platform suspended one. This invention means to find applicability on any swing no matter that the swing supporting element is a seat, seat assembly or other. The preferred embodiment along with the foregoing description is a seat suspended swing for a child or a disable person. Furthermore, the following description puts emphasis on an assisting person or group of assisting persons manually activating the mechanism in its diversity of application throughout the plurality of swing forms.

BACKGROUND

This invention relates to a manual swing drive mechanism that can be appended to a traditional swing for children or others. The object of the invention is to provide a regular pulsing action to the swing in which a person needing assistance, a child or other, is seated. Small children, although loving the swing movement of a playground swing cannot produce by themselves the so appreciated pendulum movement. The latter must thus be exerted by another party such as the mother, the father or any other person close to the child or any other person needing assistance. Usually the accompanying person pushes from the back or the front of the swing in order to produce the swinging movement. Pushing in this way may become quite energy consuming and boring after a certain time and also limits the maximum height that can be reached by the swing so limiting the pleasure of the child. It also deprives both the accompanying person and the child of the possibility of a permanent eye contact and interaction and reduces the pleasure associated with those special moments. The key improvements brought by the invention are to reduce the effort required by the accompanying person and to provide a permanent eye contact with the assisted person thus producing increased pleasure for both parties involved. Furthermore, this invention will increase the amplitude of the swing thus creating a flow of smiles and laughs.

The functionality of the manual swing drive may be expanded into a multi-swing drive mechanism thus allowing one assisting person to transmit the swing movement to a group of two or more assisted persons. It could even allow the assisting person to party with another assisting person for the transmittal of the swing movement to the group. The seat could be replaced by any other element to support the assisted persons like: double chairs, facing chairs, a tire, etc. Furthermore the swing may be safely suspended from a ceiling, a horizontal branch of a tree or any other form of horizontal cross-beam. In any one of those combinations, the invention will find its usefulness to initiate and maintain the pendulum motion on the swing with one or more assisting person.

BRIEF DESCRIPTION OF THE DRAWINGS

Preferred embodiments of the invention are now described with reference to the accompanying drawing in which.

Item #1: swaying member,
Item #2: rocking arm,
Item #3: pulling lines,
Item #4: swinging arms,
Item #6: pulling handles with associated top mounted rings,
Item #7: flexible swing lines, chains in following described embodiment,
Item #8: swing supporting horizontal cross-beam,
Item #9: hinges of the swing drive mechanism,
Item #10: height adjustment hook for chain type pulling lines,
Item #11: lower cross driven side screws.

Figure 1:
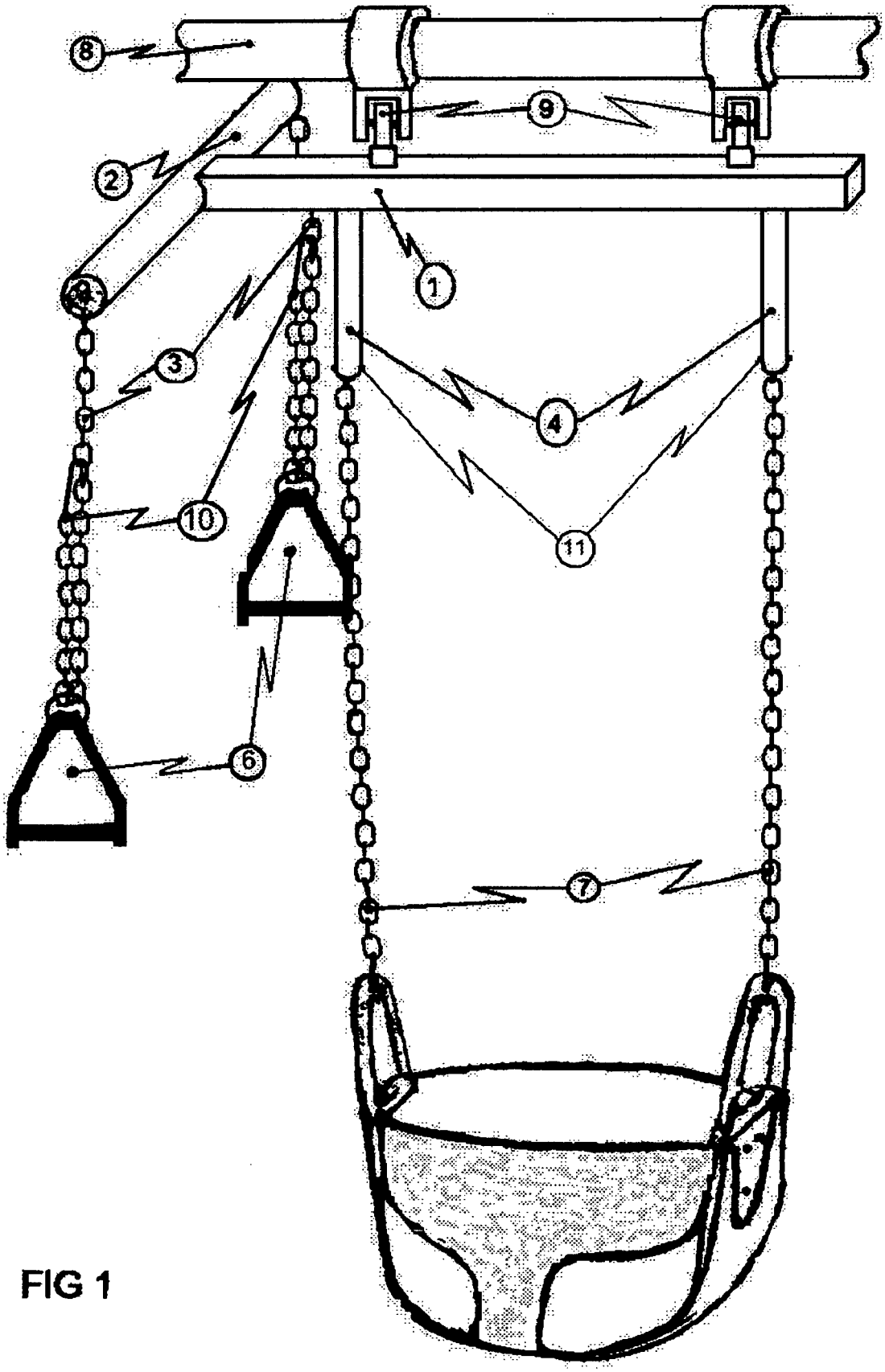
FIG. 1 depicts a perspective view of a basic swing drive mechanism including the following components.
Figure 2:
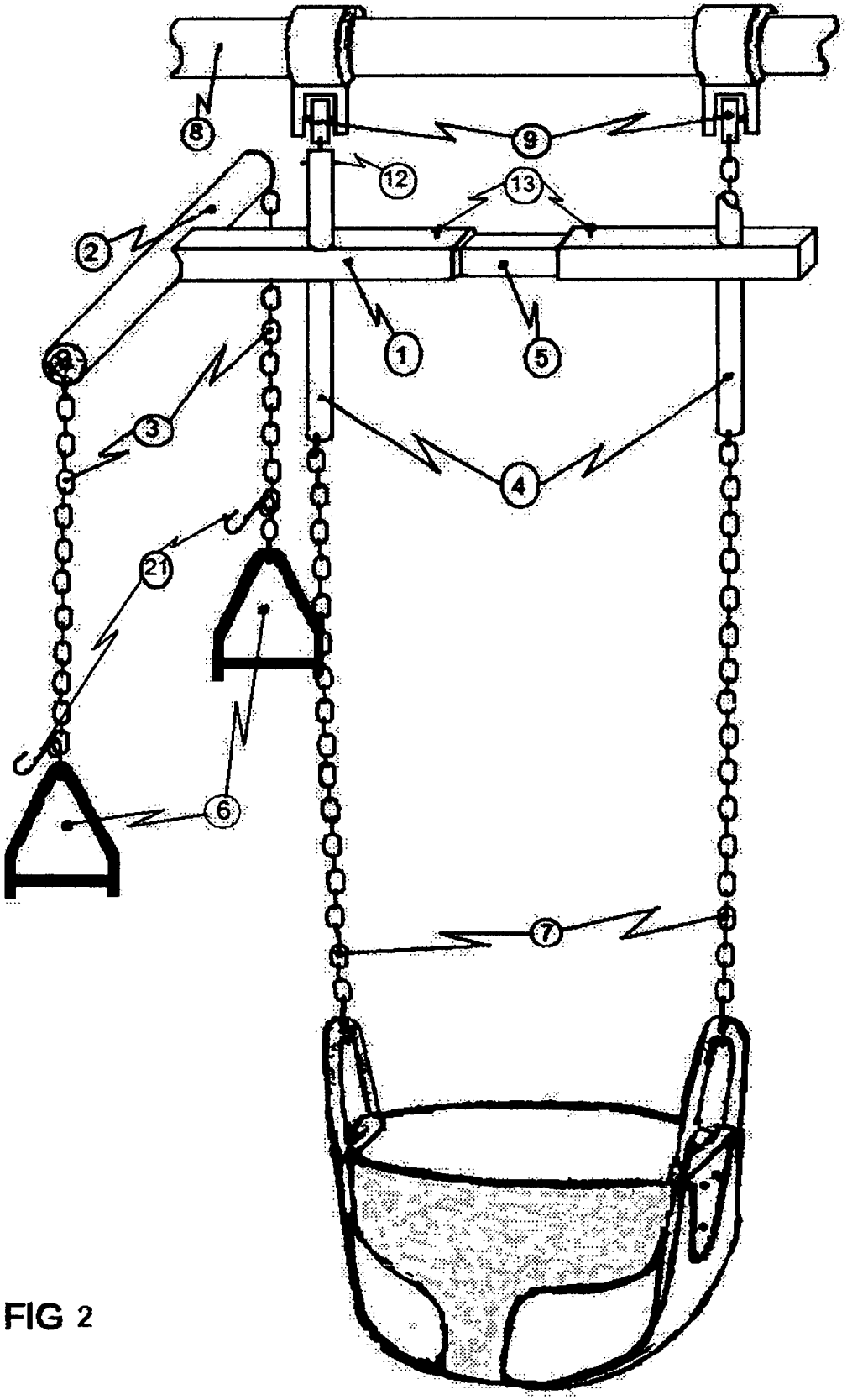

FIG. 2 depicts a perspective view of a swing drive to be mounted on an already existing swing with no or very limited modification brought on the existing swing. Compared to the standard swing drive depicted in FIG. 1, the following components are added or modified in this figure with a special accent in bold characters on main characteristics:

Item #4: hollow swinging arms,
Item #5: extension mechanism of the swaying member's,
Item #9: existing oscillatory axis of the swing line,
Item #12: cross driven screws,
Item # 13: locking screws.

Figure 3:
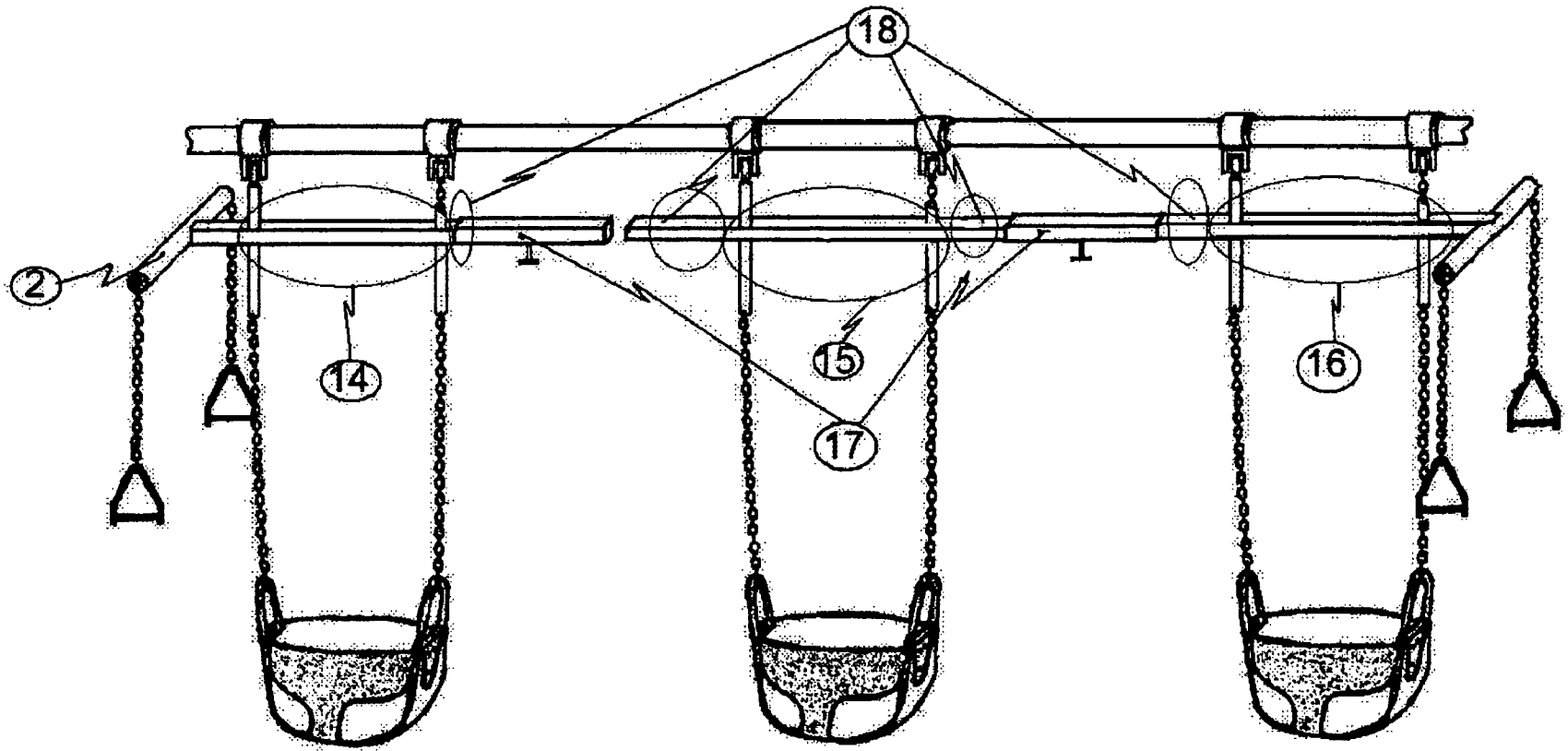

FIG. 3 depicts a perspective view of the multi-swing drive mechanism. Compared to the swing drive to be mounted on an already existing swing depicted in FIG. 2, no extension mechanism is represented in this embodiment and the following components are added or modified in this figure:

Item #14: first swing drive mechanism in the row,
Item #15: all middle swing drive mechanisms in the row,
Item #16: last swing drive mechanism in the row,
Item #17: move-and-lock sliding carriages,
Item #18: ends of swaying members.

Figure 4:
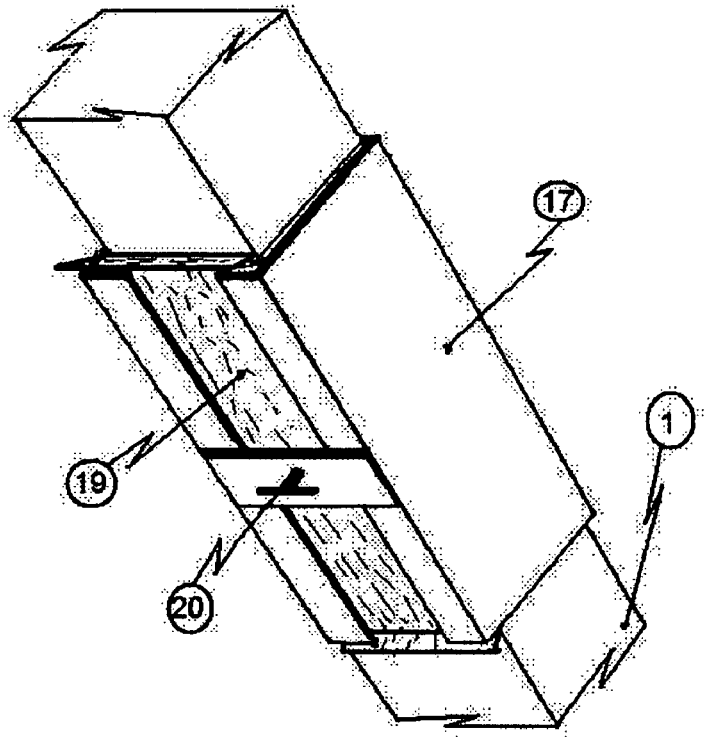

FIG. 4 depicts a perspective view of the preferred embodiment for the move-and-lock sliding carriage using a swaying member of square or rectangular cross section including the following components:

Item #19: clamping plate,
Item #20: plate tightening screw.

Figure 5:
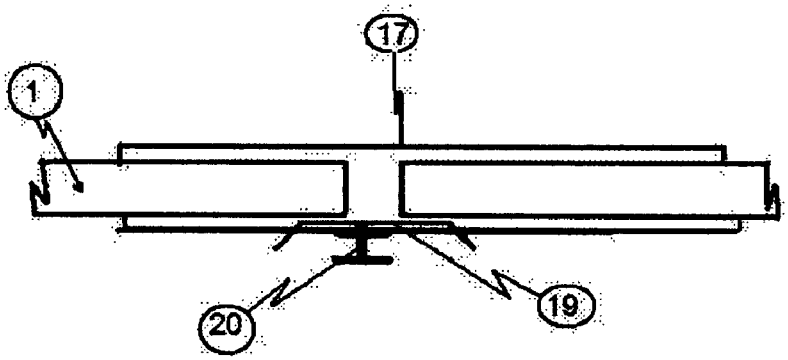
Figure 6:
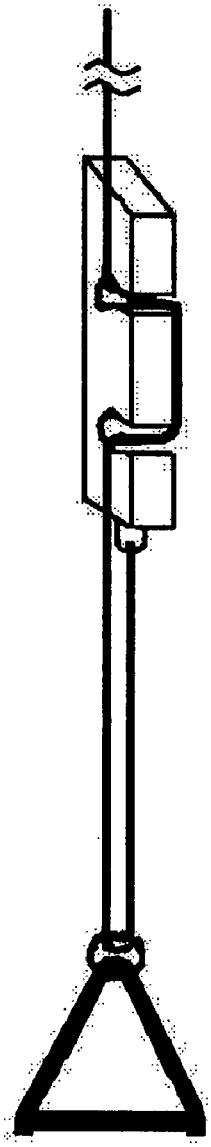
Figure 7:
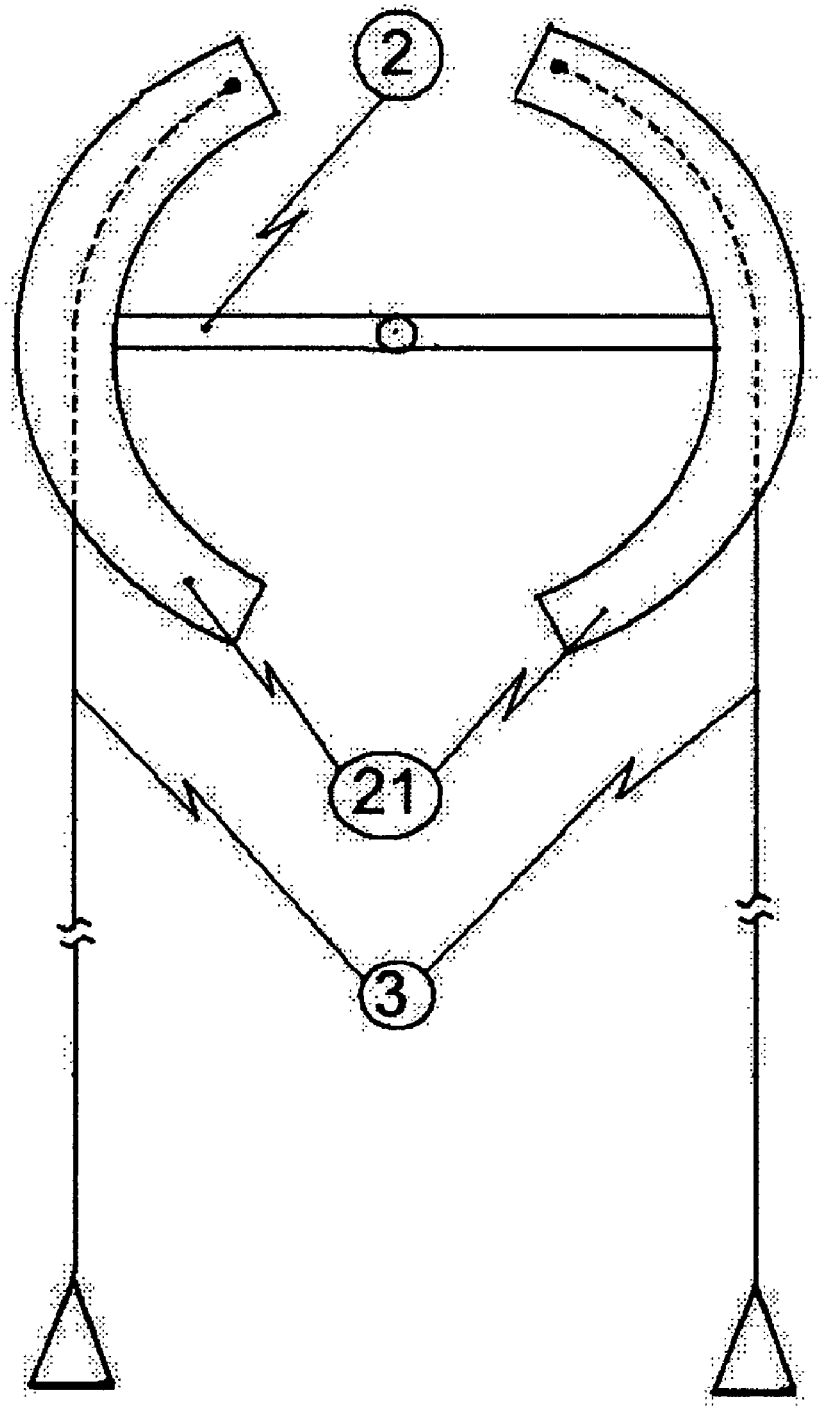

FIG. 5 depicts a section of the side elevation view of the move-and-lock carriage FIG. 6 depicts a height adjustment hook for cord type pulling lines FIG. 7 depicts a side elevation view of rocking arm including a torque constant mechanism with the following components:

Item #21: arc-shaped channel sections.
Item # 2: rocking arm
Item # 3: pulling lines

DETAILED DESCRIPTION OF THE INVENTION

The foregoing description of the invention is presented for purposes of illustration and is not intended to limit the invention to the form disclosed herein. Conventionally a swing consists of a strong horizontal cross-beam supporting a pair of flexible swing lines made of cords or chain at the bottom of which is suspended a seat, a chairs platform or any other element. The horizontal cross-beam may be secured to a building structure or as commonly seen in playgrounds, supported at its extremities by a pair of triangular support frame. It could even be constituted by a branch of a tree if the latter happens to be horizontal and strong enough. There are no special requirements for the horizontal cross-beam as long as it is strong enough to support the swing with the required level of security. In accordance with the invention, the mechanism may either be:

a) directly mounted to the horizontal cross-beam of the swing through hinges b) or integrated to an existing swing installation and make use of the existing oscillatory axis of the swing lines by insertion of the existing swing lines into the mechanism.

The base principle of the mechanism consists in oscillating the seat of the swing suspended from the pair of flexible swing lines FIG. 1, item 7, by exerting an alternating force displacement on the pair of swing lines. The latter is exerted somewhere below the oscillatory axis of the swing in the direction of the normal oscillation of the swing. These alternating force displacements originate from another person action pulling alternatively on two handles.

Basic Manual Swing Drive Mechanism.

The basic functionality of the mechanism is expressed in the embodiment depicted in FIG.

1. The supporting swinging element is chosen as a seat and steel is the fabricating material used. It basically consists of:

A swaying member, item 1, extending lengthways, below and alongside the horizontal cross-beam of the swing, item 8, firmly fixed to the latter through hinges, item 9, and free to oscillate around them.

A pair of rigid swinging arms, item 4, extending vertically, secured perpendicularly to above described swaying member in the direction of the pair of flexible swing lines, item 7. The pair of rigid swinging arms attaches and suspends the swing lines at their extremities.

A rocking arm, item 2, perpendicularly fixed by its longitudinal centre to one end of the swaying member, item 1, and forming with the latter a T-shaped assembly extending on a horizontal plane. A pair of flexible or rigid pulling lines, item 3, extending vertically, are attached by their upper ends to both extremities of the rocking arm and suspend pulling handles, item 6, at their ground ends.

Alternating pulls on the pulling handles bring the rocking arm in a pivoting movement. This pivoting movement leads an alternating rotating torque action around the hinges of the swaying member. That causes the latter to rotate slightly back and forth and to sway by the hinges, item 9, located between the cross-beam and the swaying member. An amplified swaying movement is instantaneously transmitted to the lowers ends of the pair of swinging arms dragging the attached swing lines, item 7, in an oscillating arc displacement. A pendulum movement is thus initiated on the seat suspended from the pair of swing lines and is maintained for as long as the assisting person maintains the alternating pulling action in order to keep:

a) the rocking arm rocking;

b) the swaying member swaying;

c) the extremities of the swinging arms, the swing lines and the swing seat oscillating. The arc displacement path of the seat is the one with the maximum amplitude.

Manual Swing Drive for Mounting on Existing Swing

The following exposes another application of the invention for already existing swings. As compared to the basic manual swing drive mechanism, it incorporates the following technical changes:

a) The swinging arms consist in two hollow, vertical and rigid arms. The swing lines insert in them up to the existing oscillatory axis of the swing lines fixed to the horizontal cross-beam. The hollow swinging arms are mechanically secured in that position to the swing lines. In a preferred embodiment using chains as flexible swing lines, a side bolt, item 12 of FIG. 2, cross travelling through the swinging arms and through a mesh of the chains is a particularly suitable arrangement for securing the swinging arms to the chains.

b) The swaying member is further equipped with an extension mechanism so to adapt the inter-distance between the swinging arms to the distance between the swing lines. The swaying member then consists in:

A two pieces member as it may be represented by the original one piece swaying member separated in two members by about its mid point between the pair of swinging arms.

An adjustable linking mechanism joining the two extremities of the above two pieces members and clamping them in final adjusted position. In a preferred embodiment where a metallic swaying member of square cross-section is used, the linking consists in a third member of slightly less small cross-section. The latter is slipped at appropriate distance within each respective extremity of both separated swaying members. It is then locked in place within each extremity of the two pieces by a fine thread cross driven side screw, item 13 of FIG. 2. The third member could alternatively be jammed in place in its final position by press fit or other means.

Additional Features to the Manual Swing Drive Mechanism.

When circumstances and needs require, an optional embodiment of the above manual swing drive allows technical and economical optimisation of the manufacturing. In such embodiment the swaying member, the swinging arms and the rocking arms would be moulded into a one piece assembly. It could be of steel or even plastic if allowed by rigidity criteria.

Furthermore, an other optional embodiment of the above manual swing drive mechanism for application on low supporting structure of swings would consist in using a swaying member having a vertically wide plate-shaped. The latter would extend horizontally alongside and below the cross-beam of the swing to which the upper part of this wide plate-shaped swaying member would be hooked by hinges. The lower part of the wide plate-shaped swaying member would directly attach and suspend the pair of swing lines, thus replacing the need for dedicated swinging arms on the swaying member. For a similar embodiment and adaptation of the mechanism on an already existing swing, the swaying member would consist in a vertically wide plate running in parallel and below the horizontal cross-beam of the swing and attaching each flexible swing line to the wide plate-shaped swaying member at both lower and upper parts locations. The use of two pairs of U bolts would constitute among other a good means to attach the swing lines to the wide plate-shaped swaying member. The need for specifically dedicates hollow swinging arms as described above on paragraph "Manual swing drive for mounting on existing swing" becomes no longer required.

Height of Pulling Handles

The length of the pulling lines to which the pulling handles are attached to, should be chosen to provide a comfortable position for the assisting person. To this end, a length adjustment mechanism may be provided to adjust the height of the pulling handles in accordance with the height of the assisting person. In a preferred embodiment using a chain as pulling lines and depicted in FIG. 1, such mechanism would consist in:

Pulling handles with associated top mounted rings, item 6 of FIG. 1.

Chain mesh hooks, item 10, attached to the lower extremity of the pulling lines.

The height adjustment mechanism would then be achieved by running the hooks attached to the extremity of the pulling lines inside the top mounted rings of the handles. The hook makes a U turn path travel within the rings and keeps travelling upward alongside the adjacent twin part of the pulling lines so rising up the handles. When the pulling handles are raised and adjusted to the appropriate height, the hooks at the ends of the pulling lines are then inserted into the closest side mesh of the adjacently running pulling line.

In an alternative embodiment for the height adjustment mechanism, a S hook, item 21 of FIG. 2, is mounted at the lower end of the pulling lines close to the handles. One end of the S is gripped around a mesh and the other end is let open to be attachable anywhere upward on a mesh of the pulling lines so rising up the handles at the appropriate height. Using the same principle for an embodiment using cords as pulling lines, the hook mechanisms may consist in nautical type devises such as illustrated in FIG. 6, twisting and gripping the cords in its two slots when the appropriate height is reached.

In spite of above described height adjustment mechanism, from our experienced embodiments, a height of approximately 5 feet between the ground and the bottom ends of the handles will provide for most adults a good height compromise thus removing the need for a height adjustment devise. In the case of exceptionally low swing supporting cross-beam, the handles could directly be fixed to the extremities of the rocking arms, thus eliminating the need of pulling lines.

Constant Torque Pulling Mechanism

The following intends to bring a technical optimisation on the hand pulling system of the above described swing drive mechanism by the addition of a constant torque pulling mechanism. Due to the vertical direction that characterises the force exerted on the pulling lines to rotate the swaying member, the resulting torque around the swaying member varies with the angular position of the rocking arm. In fact the torque is at maximum when the rocking arm is at horizontal and decrease towards zero when rotating toward the vertical line above and below the horizontal. It could be desirable to maintain a constant torque around the swaying member as pulling lines are being pulled down. One embodiment for so doing consists in fixing a pulley by its centre at the end of the swaying member in place of the existing rocking arm. The diameter of the pulley would be the length of the replaced rocking arm. Each pulling lines is then attached on the upper part of the pulley and travels downward within the groove on each side of the pulley toward their respective pulling handle. Another and somehow more technically optimised embodiment would consist in fixing two arc channel sections face to face to each end of the rocking arm. As shown in FIG. 7 item 21, each arc channel section would be fixed by mid points within their internal arc circumference. Pulling lines are attached each one to each upper part of the channel sections and travel down toward their respective pulling handle in winding the bottom of the grooves. In both above described embodiments, like the two sides of a belt, the pulling lines wind around the internal grooves of a pulley or a pulley like assembly, and exert a constant torque around the swaying member by rotating it into angular rotation when being alternately pulled down.

Multi-Swing Drive Mechanism

The functionality of the above described manual swing drive mechanism may be expanded into a multi-swing drive mechanism. The latter would permit an assisting person to activate more than one swing and to even do it in company of another assisting person if desired. The following description presents our preferred embodiment for a multi-swing drive mechanism and incorporates the following choices:

The supporting swinging elements of the swings are seats.

The manufacturing material is metal due to the overall strength required on the complete assembly mostly at linking points of the swing drive mechanisms.

The cross section of the swaying members is rectangular or square.

Referring to FIG. 3, the multi-swing drive mechanism then consists in a row of close identical swing drive mechanisms. Each one attaches and suspends its own pair of seat lines. In this row of swing drives:

a) The first swing drive, item 14 of FIG. 3, is mounted and designed as the one described for the basic swing drive mechanism and illustrated in FIG. 1. The swaying member is yet lengthened on the opposite side of the rocking arm, item 18 FIG. 3, to allow mechanical attachment to the next swaying member of the row.

b) All middle swing drives item 15 FIG. 3, are also mounted and designed as the basic swing drive mechanism illustrated in FIG. 1. Yet, instead of incorporating a rocking arm as on the first one, item 2 FIG. 3, the swaying members are lengthened on each side, item 18 FIG. 3, to allow attachment to each of their neighbouring swaying members.

c) The last swing drive in the row, item 16 FIG. 3, is also identical mechanically and in the mounting to the first one, item 14. But it incorporates a rocking arm at the opposite extreme end of the row of swings so as to provide pulling lines and pulling handles on the last swing of the row for a second assisting person.

d) Linking mechanisms allow solid mechanical attachments between the individual swaying members when the assisting person requires it. Although various designs of linking mechanisms may be selected, in our preferred embodiment, our choice has been fixed on a move-and-lock sliding carriage such as depicted in detail in FIGS. 4 and 5. It consists in a channel as illustrated in item 17 FIG. 4, inserting lengthways a clamping plate, item 19 of FIG. 4, which is moved across by a T-shaped handle screw, item 20 of FIG. 4. By sliding the carriage sideways, the two ends of the neighbouring swaying members slip into and get inserted within the carriage between the bottom of the channel and the clamping plate. By screwing the T-shaped handle, the two ends of the swaying members are jammed in place.

The embodiments of the invention for which an exclusive property or privilege is claimed are defined as follows:

1. A manual swing drive mechanism to manually initiate and maintain a pendulum swinging movement on swing lines of said swing, said swing drive mechanism comprising:

a) a swaying member extending in parallel, below and alongside the horizontal supporting cross-beam of said swing, said swaying member being fixed to said cross-beam by hinges, b) a rocking arm with longitudinal centre perpendicularly fixed at one extremity of said swaying member so that said rocking arm with said swaying member forms a T-shaped assembly extending on an horizontal plane, below said swing horizontal supporting cross-beam, c) two rigid swinging arms separated of each other by the same distance as said swing lines so to support said swing lines, said rigid swinging arms fixed vertically and perpendicularly to said swaying member with one arm fixed at approximately six inches from said rocking arm, said swinging arms suspending and attaching from their lower ends said swing lines, d) two parallel pulling lines extending vertically towards the ground, each one attached to and suspended from each extremity of said rocking arm and each one mounting a pulling handle at its lower end.

2. A manual swing drive mechanism as in claim 1, in which said rigid swinging arms are of hollow tube-shaped type, thus allowing said swing lines to be inserted there in up to the oscillating axis of said swing lines and allowing said swing lines to attach by said swing arms and to support said swing drive mechanism.

3. A manual swing drive mechanism as according to any one of claims 1 and 2, in which a length adjustable extension mechanism is provided on said swaying member between the pair of swing lines, said extension mechanism consisting in the swaying member being separated by about mid point between the pair of swing lines and in a third member joining the two by insertion in each extremity of the two said swaying members and by clamping them at appropriate length between said swing arms.

4. A manual swing drive mechanism as according to any one of claims 1 and 2, in which said pulling handles are provided with height adjustment as related to ground, consisting of handles to various parts alongside said pulling lines.

5. A manual swing drive mechanism as according to any one of claims 1 and 2, in which said swaying member, said swinging arms and said rocking arm are formed in a one piece moulded assembly.

6. A manual swing drive mechanism as in claim 1, in which said swaying member and said swinging arms consist in a vertically wide plate-shaped member, hooked through hinges to said cross-beam by the upper part of said wide plate-shaped member, extending horizontally alongside and below said cross-beam and securely attaching and suspending said swing lines from bottom part.

7. A manual swing drive mechanism as in claim 1 in which said swaying member and said swing arms consist in a vertically wide plate-shaped member extending horizontally alongside and below said cross-beam, said wide plate-shaped member attaching each swing line of said swing to both upper and lower part of said wide plate-member.

8. A manual swing drive mechanism as according to any one of claims 1, 2, 3, 4, 5, 6, and 7, incorporating a constant torque pulling mechanism consisting in:

a pulley replacing the rocking arm and having the diameter of said rocking arm, said pulley fixed by centre to an extremity of said swaying member, two pulling lines as in claim 1 attachable to the upper part of said pulley, each said pulling line traveling downward within the grooves and on each respective side of said of said pulley toward their respective pulling handle.

9. A manual swing drive mechanism as according to any one of claim 1, 2, 3, 4, 5, 6, and 7, incorporating a constant torque pulling mechanism consisting in:

a pair of channel sections mounted face to face by their internal arc longitudinal mid-point to each respective end of said rocking arms, said two pulling lines attached to the upper part on each arc channel section, each said pulling line traveling downward within the grooves and on each respective side of said arc channel sections toward their respective pulling handle.

10. A manual multi-swing drive mechanism consisting in a row of similar, parallel, and single swing drive mechanism as according to one of claims 1, 2, 3, 4, and 5, said row of swing drive mechanism aligned along and suspended from the horizontal supporting cross-beam of said swing, said single swing drive mechanisms mechanically linkable one to another at user's will for seat swinging actuation, each one said single drive mechanism attached to its own pair of swing lines and in which said row of swing drives:

a) the swaying member of the first one is lengthened on the opposite side of the rocking arm so to be linked with the next following and adjacent swing drive, b) the rocking arms of all middle one are removed and replaced by lengthening of swaying members on each side to allow attachment of each to their neighbouring swaying members, c) the rocking arm of the last swing drive in the row is located at the extreme opposite of said row, d) an inter-swaying shaft linking mechanism which permits a solid mechanical attachment between individual swaying members as per user's will.

* * * * *